US006814614B2

(12) United States Patent
Kuroki et al.

(10) Patent No.: US 6,814,614 B2
(45) Date of Patent: Nov. 9, 2004

(54) ELECTRICAL CONNECTOR HAVING CONTACTS WITH CONNECTING PORTIONS FORMED OBLIQUELY IN A DIRECTION OF THE ALIGNED CONTACTS

(75) Inventors: Yoshihide Kuroki, Tokyo (JP); Yoshifumi Kubota, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/694,745

(22) Filed: Oct. 29, 2003

(65) Prior Publication Data

US 2004/0092160 A1 May 13, 2004

(30) Foreign Application Priority Data

Nov. 6, 2002 (JP) ..... 2002-322549

(51) Int. Cl.[7] ..... H01R 9/05
(52) U.S. Cl. ..... 439/579; 439/494; 439/874
(58) Field of Search ..... 439/579, 11, 492–499, 439/874

(56) References Cited

U.S. PATENT DOCUMENTS 4,993,969 A 2/1991 Cabourne ..... 439/499
5,267,881 A 12/1993 Matuzaki ..... 439/660
5,643,010 A * 7/1997 Wu ..... 439/598
5,653,608 A * 8/1997 Saligny ..... 439/404
5,692,928 A * 12/1997 Nelson et al. ..... 439/733.1
5,722,861 A * 3/1998 Wetter ..... 439/701
6,113,438 A * 9/2000 O'Sullivan ..... 439/740
6,200,163 B1 * 3/2001 O'Sullivan ..... 439/579
6,217,374 B1 * 4/2001 O'Sullivan ..... 439/499
6,280,209 B1 8/2001 Bassler et al. ..... 439/101
6,312,294 B1 * 11/2001 Lai ..... 439/692
2003/0064625 A1 * 4/2003 Ozai ..... 439/579

OTHER PUBLICATIONS

European Search Report, dated Feb. 23, 2004.

* cited by examiner

*Primary Examiner*—Michael C. Zarroli
(74) *Attorney, Agent, or Firm*—Baker Botts L.L.P.

(57) ABSTRACT

In a connector member, each of contacts has a contact portion to be connected to a counterpart connector, a retention portion retained by an insulator, and a connecting portion to be connected with a cable. Each connecting portion is connected with the cable by soldering and projected from the insulator in an axial direction of the contact. Each connecting portion is formed obliquely in a contact pitch direction of the connector. A plug connector is provided with a shell on an upper surface of the connector member, and covered with a hood so as to expose a fitting portion.

10 Claims, 6 Drawing Sheets

ELECTRICAL CONNECTOR HAVING CONTACTS WITH CONNECTING PORTIONS FORMED OBLIQUELY IN A DIRECTION OF THE ALIGNED CONTACTS

This application claims priority to prior Japanese patent application JP 2002-322549, the disclosure of which is incorporated herein by reference.

BACKGROUND OF THE INVENTION

The present invention relates to a connector, and more specifically, to a narrow-pitch connector mounted in a portable personal digital assistant (PDA) or the like as an interface, and further to a shape of a contact thereof.

Conventionally, an electrical connector of this type includes an insulator and a plurality of contacts retained in array by the insulator.

Each contact is formed near one end thereof with a connecting portion extending in a direction substantially perpendicular to a thickness direction of the contact for soldering a cable or a lead wire thereto. A forward end of the connecting portion formed near the one end of each contact is located with a clearance in a contact pitch direction of the connector from the adjacent contact near the other end thereof.

For enabling mounting of the conventional bent-shaped contacts, interference between the contacts is prevented by deviating the positions of the connecting portions outside the maximum width of the contact. However, the whole connector is enlarged in size corresponding to the deviation of the positions of the connecting portions, and therefore, it has been difficult to achieve reduction in size of the whole connector.

Further, conventionally, the shape of the connecting portion of each contact that becomes necessary, for example, upon soldering a cable or a lead wire, is formed by perpendicular bending of one end of the contact. With respect to the bent shape of the connecting portion of the conventional contact, when applied to a narrow-pitch connector, a range corresponding to a distance from a forward end of the connecting portion formed near the one end of each contact interferes with the adjacent contact, and therefore, it has been difficult to mount the contacts in the insulator.

Moreover, since distances each between the connecting portions of the adjacent contacts increase, respectively, and become asymmetric to each other, there is a drawback in a connector for use in high-speed differential transmission that an impedance changes depending on a combination of terminals to which differential signals are fed.

SUMMARY OF THE INVENTION

Therefore, it is an object of the present invention to provide a narrow-pitch plug connector including contacts each having a cable connecting portion, which has been improved in size reduction and high-speed transmission characteristic.

It is another object of the present invention to provide a plug member that is used in the foregoing plug connector.

According to one aspect of the present invention, there is provided a connector which includes a plurality of contacts arrayed in a contact pitch direction, and an insulator fixedly retaining the contacts. In the connector, each of the contacts includes a contact portion to be connected to a counterpart connector, a retention portion retained by the insulator, and a terminal portion to be connected with a cable or a lead wire. The terminal portion includes a connecting portion to which the cable or lead wire is soldered, and is projected from the insulator in an axial direction of the contact. The connecting portion is formed obliquely in the contact pitch direction.

Here, in the present invention, it is preferable that the connecting portions are formed zigzag in the contact pitch direction in the foregoing connector.

Further, according to another aspect of the present invention, there is provided a connector member includes a plurality of contacts arrayed in a contact pitch direction being a second direction crossing a first direction being a fitting direction, and an insulator fixedly retaining the contacts. In the connector member, each of the contacts includes a contact portion to be connected to the counterpart connector, a retention portion retained by the insulator, and a terminal portion to be connected with a cable or a lead wire. The terminal portion includes a connecting portion to which the cable or lead wire is soldered, and is projected from the insulator in an axial direction of the contact. The connecting portion is formed obliquely in the contact pitch direction.

DESCRIPTION OF THE PREFERRED EMBODIMENT

Prior to describing a preferred embodiment of the present invention, conventional connectors will be described with reference to FIGS. 1A to 3E for facilitating understanding of the present invention.

Figure 1A:
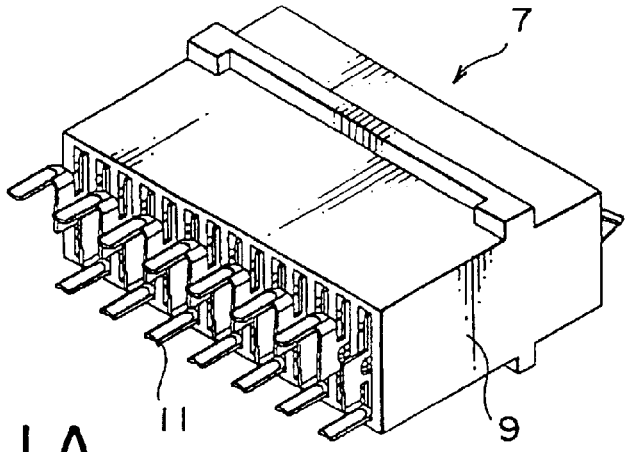
FIG. 1A PRIOR ART
FIG. 1A is a perspective view showing one example of a conventional connector, seen from the connection side thereof as the front.
Figure 1B:
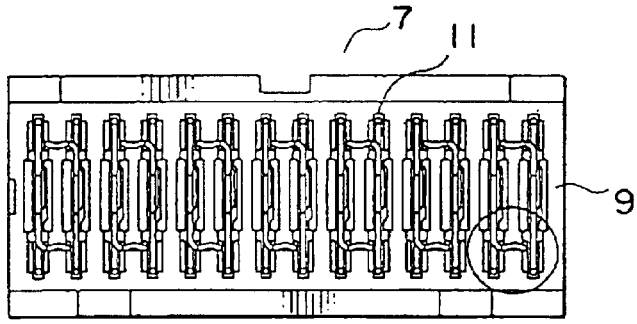
FIG. 1B PRIOR ART
FIG. 1B is a front view seen from the connection side of the connector shown in FIG. 1A.
Figure 1C:
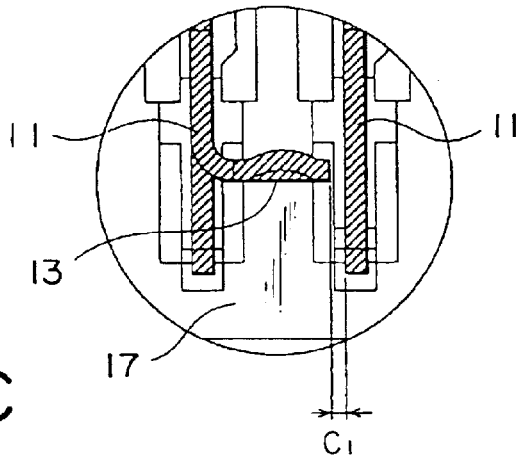
FIG. 1C PRIOR ART
FIG. 1C is an enlarged view of a circled portion in FIG. 1B.

In FIGS. 1A to 1C, contacts are shown by hatching for better understanding. Referring to FIGS. 1A to 1C, a connector 7 is a narrow-pitch connector having a contact pitch of, for example, 1.1 mm. The connector 7 comprises an insulator 9 and fourteen contacts 11 retained in array by the insulator 9.

Each contact 11 is formed near one end thereof with a connecting portion 13 extending in a direction substantially perpendicular to a thickness direction of the contact 11 for soldering a cable thereto. A forward end of the connecting portion 13 formed near the one end of each contact 11 is located with a clearance C1 in a contact pitch direction of the connector from the adjacent contact 11 near the other end thereof.

Figure 2A:
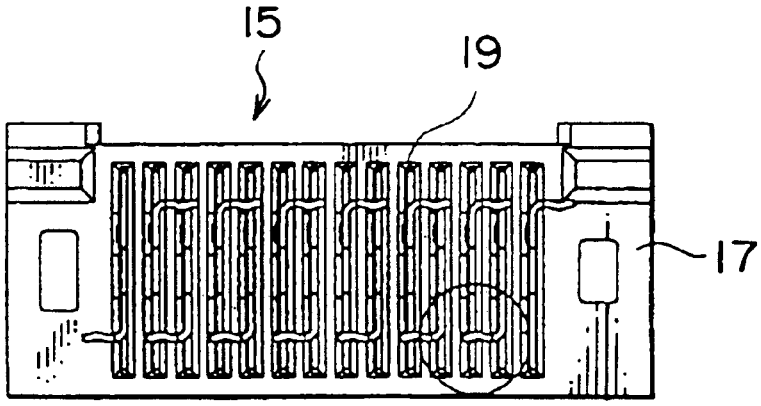
FIG. 2A PRIOR ART
FIG. 2A is a front view showing another example of a conventional connector, seen from the connection side thereof.
Figure 2B:
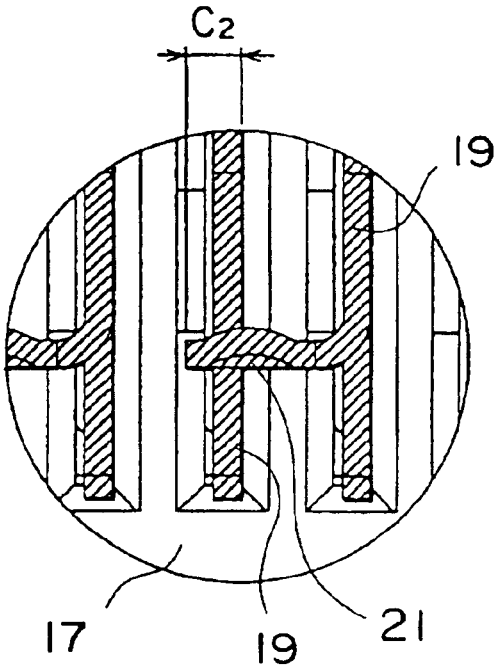
FIG. 2B PRIOR ART
FIG. 2B is an enlarged view of a circled portion of the connector shown in FIG. 2A.

In another example of the conventional connector shown in FIGS. 2A and 2B, contacts are also shown by hatching.

Referring to FIGS. 2A and 2B, a connector 15 is a narrow-pitch connector having a contact pitch of 0.7 mm. The connector 15 includes an insulator 17 and fourteen contacts 19 retained in array by the insulator 17.

As best shown in FIG. 2B, each contact 19 is formed near one end thereof with a connecting portion 21 extending in a direction substantially perpendicular to a thickness direction of the contact 19 for soldering a cable thereto.

Figure 3A:
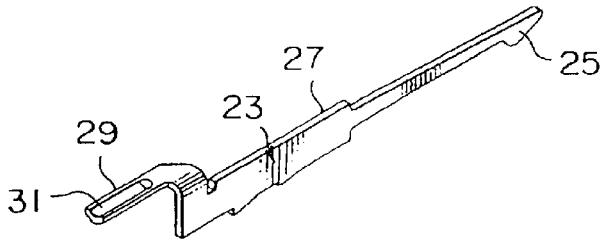
FIG. 3A PRIOR ART
FIG. 3A is a perspective view showing a contact of a conventional connector of still another example.

Referring to FIG. 3A, a conventional contact 23 of still another example includes a tip portion 25, a retention portion 27 that is press-fitted into an insulator to be retained thereby, a terminal portion 29 having a width in a thickness direction of the contact 23 and extending in a longitudinal direction thereof. The terminal portion 29 is provided with a connecting portion 31 that is curved semicylindrically for soldering a lead wire thereto.

Figure 3B:
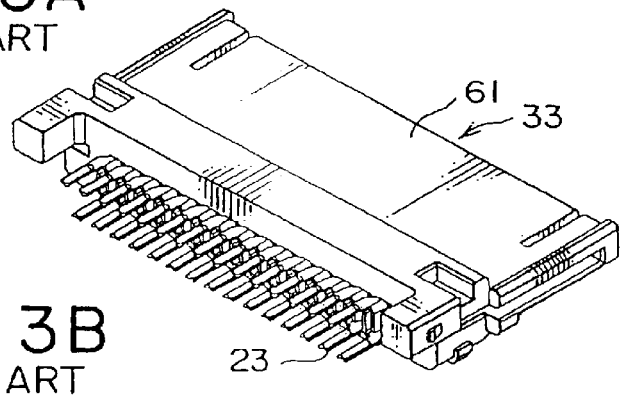
FIG. 3B PRIOR ART
FIG. 3B is a perspective view seen from the connection side of the connector having contacts each as shown in FIG. 3A.
Figure 3C:
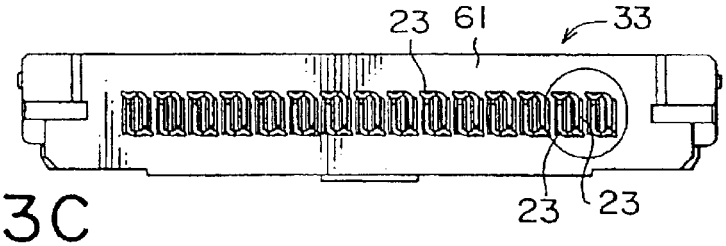
FIG. 3C PRIOR ART
FIG. 3C is a front view seen from the connection side of the connector shown in FIG. 3B.

As shown in FIGS. 3B and 3C, a connector 33 comprises an insulator 61 and the contacts 23 each press-fitted into a retaining portion of the insulator 61 from a contact hole 62 so as to be retained thereby.

Figure 3D:
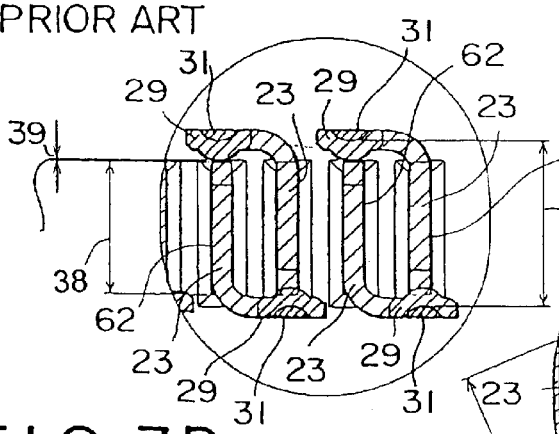
FIG. 3D PRIOR ART
FIGS. 3D and 3E are sectional views, respectively, of a circled portion in FIG. 3C.
Figure 3E:
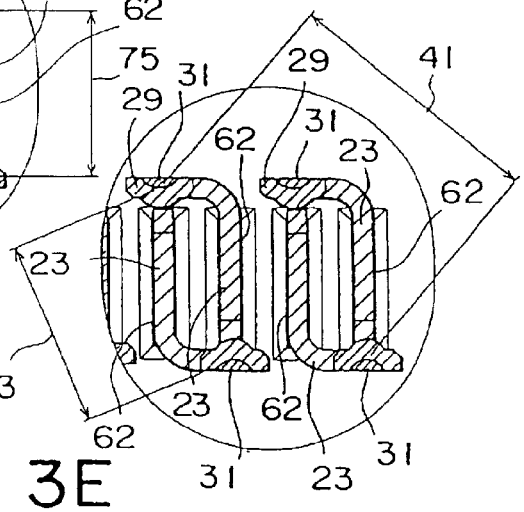
FIG. 3E PRIOR ART

Referring to FIGS. 3D and 3E, when mounting the contacts having two kinds of shapes of the connecting portions, it is necessary to provide a clearance 39 so that the connecting portion of either one of the contacts is prevented from interfering with a width 38 of the adjacent contact.

In any of the conventional examples shown in FIGS. 1B, 2B, and 3D, for enabling mounting of the conventional bent-shaped contacts, interference between the contacts 23 is prevented by deviating the positions of the connecting portions outside the maximum width of the contact. However, the whole connector is enlarged in size corresponding to the deviation of the positions of the connecting portions, and therefore, it has been difficult to achieve reduction in size of the whole connector.

As shown in FIG. 1B, in the conventional example, the shape of the connecting portion of each contact that becomes necessary upon soldering the cable is formed by perpendicular bending. With respect to the bent shape of the connecting portion of the conventional contact, when applied to the narrow-pitch connector shown in FIG. 2B, a range corresponding to a distance C2 from a forward end of the connecting portion 21 formed near the one end of each contact 19 interferes with the adjacent contact 19, and therefore, it has been difficult to mount the contacts 19 in the insulator 17.

As shown in FIG. 3E, since distances 41 and 43 each between the connecting portions of the adjacent contacts increase, respectively, and become asymmetric to each other, there is a drawback in a connector for use in high-speed differential transmission that an impedance changes depending on a combination of terminals to which differential signals are fed.

Now, the preferred embodiment of the present invention will be described with reference to the drawings.

Figure 4A:
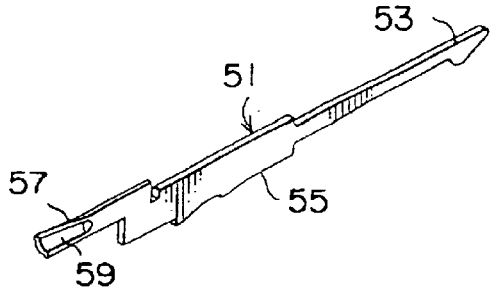
FIG. 4A is a perspective view of a contact of a plug connector, seen from the side of a connecting portion thereof, according to a preferred embodiment of the present invention.

As shown in FIG. 4A, a contact 51 is in the form of an elongate metal plate and comprises a contact portion 53 at one end thereof, a retention portion 55 extending from the contact portion 53 in a longitudinal direction, and a terminal portion 57 stepped upward from the retention portion 55 and extending in the longitudinal direction. The retention portion 55 is press-fitted into a receiving portion of an insulator 61 so as to be retained thereby. The terminal portion 57 has a connecting portion 59 formed into an arc-like or semiannular shape in cross section and inclined at substantially 45° relative to a thickness direction of the contact (a contact pitch direction of a connector).

Figure 4B:
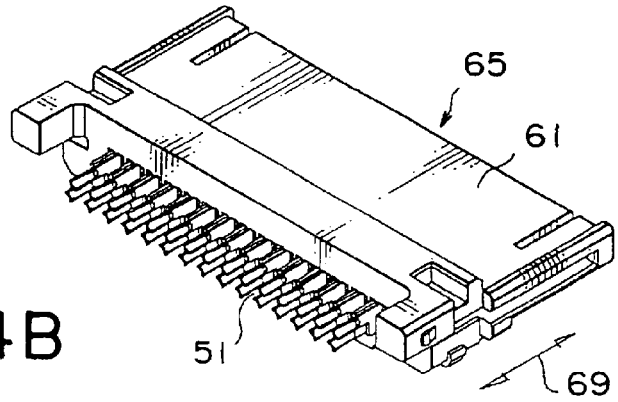
FIG. 4B is a perspective view showing a connector body of the plug connector having contacts each as shown in FIG. 4A, seen from the side of connecting portions of the contacts.
Figure 4C:
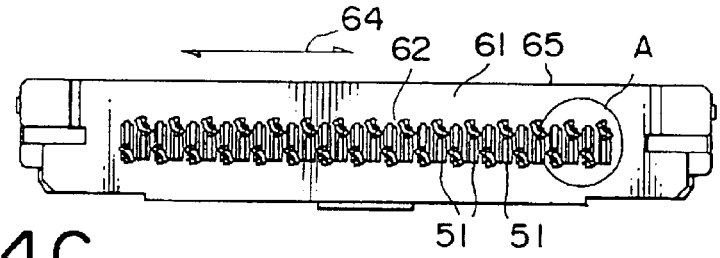
FIG. 4C is a front view seen from the connection side of the plug connector body.

As shown in FIGS. 4B and 4C, a plug connector body 65 comprises the insulator 61 and thirty contacts 51 retained in array in the receiving portion provided in the insulator 61. The contacts 51 are disposed in the contact pitch direction so as to be inverted alternately. An arrow 69 represents an axial direction of the contact 51.

Figure 4D:
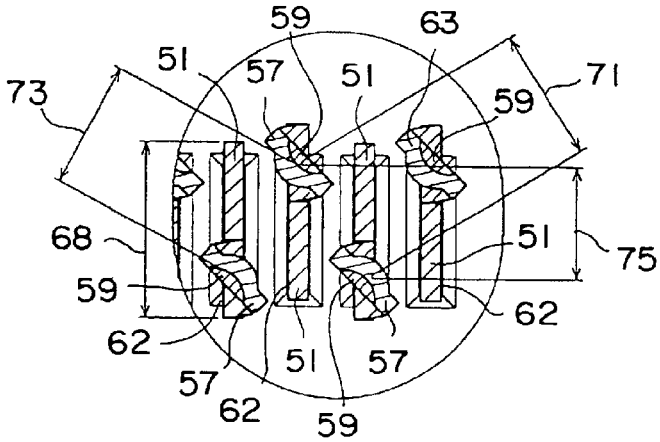
FIG. 4D is an enlarged view of a circled portion in FIG. 4C.

Referring to FIG. 4D, the connecting portion 59 formed on a free end side of the terminal portion 57 of the contact 51 is disposed so as to confront the connecting portion 59 located on the upper left side thereof and formed near one end of the adjacent contact 51 on the left, with an interval 71 defined therebetween, while confront the connecting portion 59 located on the upper right side thereof and formed near one end of the adjacent contact 51 on the right, with an interval 73 defined therebetween. Incidentally, numeral 68 denotes a width (height) of the contact.

As described above, since it is configured that the connecting portion 59 of each contact 51 is inclined at substantially 45° relative to the contact pitch direction, it is possible to prevent interference between the adjacent contacts 51 upon mounting the contacts 51, with the minimum distance between the adjacent contacts 51. Further, since the intervals 71 and 73 each between the connecting portions 59 of the adjacent contacts 51 are substantially symmetric to each other, it is possible to prevent occurrence of a difference in impedance depending on a combination of the contacts 51, and therefore, to achieve impedance matching of the connector for high-speed transmission.

Further, since an interval (height) 75 between the connecting portions 59 of the contacts 51 in a vertical direction can be shortened, the height of the connector can be lowered.

Figure 5A:
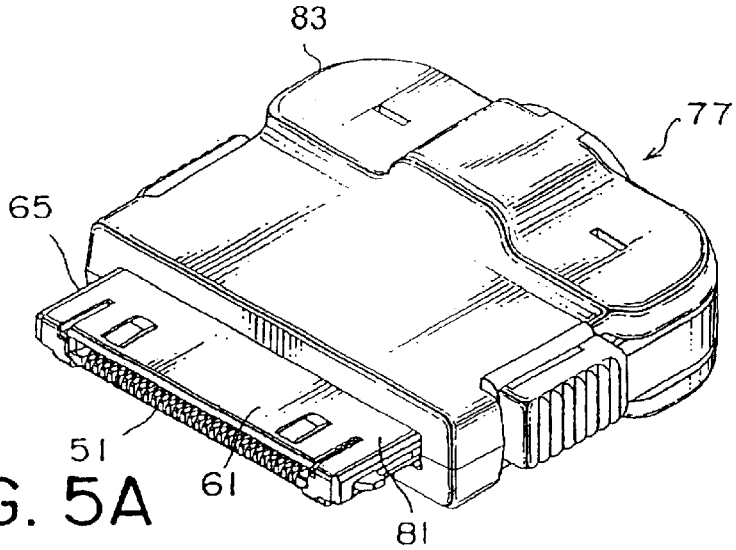
FIG. 5A is a perspective view showing the whole of the plug connector according to the preferred embodiment of the present invention.

As shown in FIG. 5A, in a plug connector 77, the plug connector body 65 is covered with a shell 81 on an upper surface of the insulator 61 on the fitting side thereof. The insulator 61 other than the fitting side thereof and the contacts 51 are wholly covered with a hood 83.

Figure 5B:
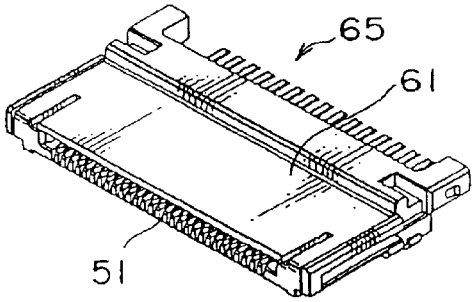
FIG. 5B is a perspective view showing the connector body of the plug connector shown in FIG. 5A, seen from the side of contact portions of the contacts as the front.
Figure 5C:
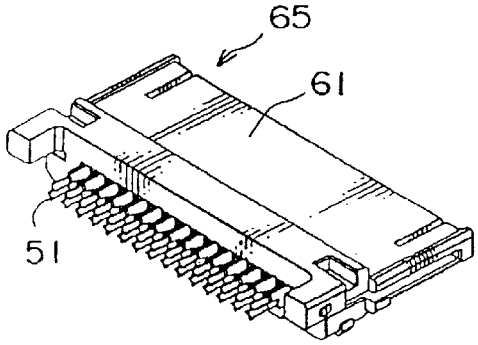
FIG. 5C is a perspective view showing the connector body shown in FIG. 5B, seen from the side of the connecting portions of the contacts.

As shown in FIGS. 5B and 5C, the contact portions 53 of the thirty contacts 51 on the fitting side are retained on one side of the insulator 61 of the plug connector 77, while the terminal portions 57 of the thirty contacts 51 having the connecting portions 59 exposed to the exterior on the connection side are retained on the other side of the insulator 61 of the plug connector 77. Each contact 51 includes, as shown in FIG. 4A, the contact portion 53 to be connected to a counterpart connector, the retention portion 55 to be retained by the insulator 61, and the terminal portion 57 provided with the connecting portion 59 to be connected to a cable.

Figure 7:
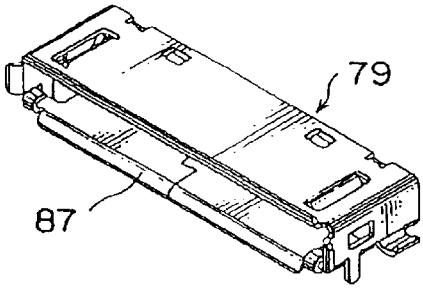
FIG. 7 is a perspective view of a receptacle connector adapted to receive the plug connector shown in FIGS. 5A to 5C.

In FIG. 7, when the plug connector 77 is fitted into a receptacle connector 79, the contact portions of the contacts 51 of the plug connector 77 on the fitting side are connected to contact portions of contacts (not shown) of the receptacle connector 79 on the side of a fitting portion 87, respectively.

Figure 6:
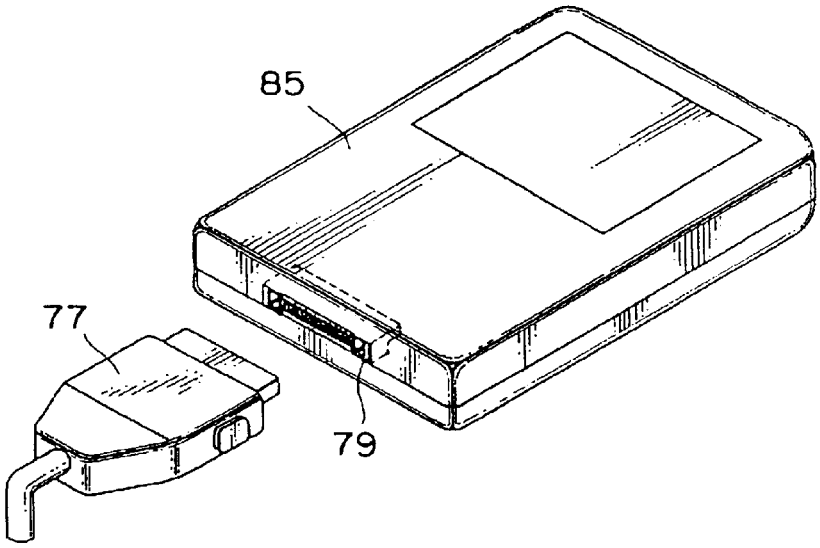
FIG. 6 is a perspective view showing the plug connector of FIG. 5A and a portable personal digital assistant (PDA) provided with the receptacle connector of FIG. 7 in the state before connection therebetween.

FIG. 6 is a perspective view showing the plug connector 77 of FIG. 5A and a portable personal digital assistant (PDA) 85 provided with the receptacle connector 79 of FIG. 5D in the state before connection therebetween. When the plug connector 77 is fitted into the receptacle connector 79 provided on a lower end surface of the PDA 85, the contact portions 53 of the contacts 51 of the plug connector 77 on the fitting side are connected to the contact portions of the contacts of the receptacle connector 79 on the side of the fitting portion 87.

In this embodiment, the thirty contacts 51, each after having been pressed into the shape having the contact portion 53, the retention portion 55, and the terminal portion 57 having the connecting portion 59, are simultaneously press-fitted into the insulator 61 in a lump.

As described above, according to the present invention, it is possible to provide the narrow-pitch plug connector including the contacts each having the cable connecting portion, which has been improved in size reduction and high-speed transmission characteristic.

What is claimed is:

1. A plug connector comprising a plug connector body to be fitted to a counterpart connector in a first direction, a shell covering at least one surface of said plug connector body, and a hood covering said plug connector body along with said shell while exposing one end side thereof in said first direction;

said plug connector body comprising a plurality of contacts arrayed in a second direction crossing said first direction, and an insulator fixedly retaining said contacts, each of said contains comprising a contact portion to be connected to the counterpart connector, a retention portion retained by said insulator, and a terminal portion to be connected with a cable or a lead wire;

said terminal portion comprising a connecting portion to which said cable or lead wire is soldered, and is projected from said insulator in said first direction, said connecting portion being formed obliquely in said second direction; wherein said retention portion is press-fitted into said insulator to be fixedly retained thereby, such that a thickness direction of said contact agrees with said second direction, and a width direction of said contact agrees with a height direction being a third direction crossing said first and second directions.

2. The plug connector according to claim 1, wherein said connecting portions are staggered alternately in said second direction.

3. The plug connector according to claim 1, wherein each of said connecting portions is oriented in the same direction and is inclined at substantially 45° relative to said second direction.

4. The plug connector according to claim 1, wherein the mutually adjacent contacts are formed such that a distance between said connecting portions is greater than an interval between said connecting portions in said third direction, and less than a length of said contact in the height direction.

5. A portable personal digital assistant comprising said first counterpart connector according to claim 1, wherein said first counterpart connector receives an interface comprising said plug connector according to claim 1.

6. An electrical connector member comprising a plurality of contacts arrayed in a second direction crossing a first direction being a fitting direction, and an insulator fixedly retaining said contacts;

each of said contacts comprising a contact portion to be connected to a counterpart connector, a retention portion retained by said insulator, and a terminal portion to be connected with a cable or a lead wire;

said terminal portion comprising a connecting portion to which said cable or lead wire is soldered, and is projected from said insulator in said first direction;

said connecting portion being formed obliquely in said second direction; wherein said retention portion is press-fitted into said insulator to be fixedly retained thereby, such that a thickness direction of said contact agrees with said second direction, and a width direction of said contact agrees with a height direction being a third direction crossing to said first and second directions.

7. The connector member according to claim 6, wherein said connecting portions are staggered alternately in said second direction.

8. The connector member according to claim 6, wherein each of said connecting portions is oriented in the same direction and is inclined at substantially 45° relative to said second direction.

9. The connector member according to claim 6, wherein the mutually adjacent contacts are formed such that a distance between said connecting portions is greater than an interval between said connecting portions in said third direction, and less than a length of said contact in the height direction.

10. A portable personal digital assistant comprising said counterpart connector of claim 6, wherein said connector member receives an interface comprising said second connector member according to claim 7.

* * * * *